United States Patent [19]

Kandathil

[11] Patent Number: 4,795,032

[45] Date of Patent: Jan. 3, 1989

[54] WASH-ADDED, RINSE-ACTIVATED FABRIC CONDITIONER AND PACKAGE

[75] Inventor: Thomas V. Kandathil, Racine, Wis.

[73] Assignee: S. C. Johnson & Son, Inc., Racine, Wis.

[21] Appl. No.: 129,130

[22] Filed: Dec. 4, 1987

[51] Int. Cl.[4] ..... B65D 33/36

[52] U.S. Cl. ..... 206/634; 206/a.5; 206/632; 383/102; 8/158

[58] Field of Search ..... 206/0.5, 219, 524.7, 206/632, 634; 252/90, 91; 383/1, 102; 8/150, 158, 159

[56] References Cited

U.S. PATENT DOCUMENTS

| | | | |
|---|---|---|---|
| 3,034,911 | 5/1962 | McKee et al. . | |
| 3,349,033 | 10/1967 | Zuccarelli . | |
| 3,351,483 | 11/1967 | Miner et al. . | |
| 3,360,470 | 12/1967 | Wixon . | |
| 3,383,236 | 5/1968 | Brindamour . | |
| 3,554,784 | 1/1971 | Lyness . | |
| 3,576,760 | 4/1971 | Gould et al. . | |
| 3,594,212 | 7/1971 | Ditsch et al. . | |
| 3,647,354 | 3/1972 | Loeb | 68/20 |
| 3,660,286 | 5/1972 | Sepulveda et al. . | |
| 3,681,248 | 8/1972 | Gould et al. . | |
| 3,686,025 | 8/1972 | Morton . | |
| 3,749,691 | 7/1973 | Kandathil . | |
| 3,822,145 | 7/1974 | Liebowitz et al. . | |
| 3,888,999 | 6/1975 | Jones et al. | 206/0.5 |
| 3,892,669 | 7/1975 | Rapisarda et al. . | |
| 3,896,033 | 7/1975 | Grimm . | |
| 3,915,867 | 10/1975 | Kang et al. . | |
| 3,915,882 | 10/1975 | Nirschl et al. . | |
| 3,937,396 | 2/1976 | Schneider | 383/94 |
| 3,947,971 | 4/1976 | Bauer . | |
| 3,974,076 | 8/1976 | Wiersema et al. . | |
| 3,977,980 | 8/1976 | Fry et al. . | |
| 3,989,853 | 11/1976 | Forkner | 383/66 |
| 4,014,432 | 3/1977 | Clothier et al. | 206/0.5 |
| 4,018,688 | 4/1977 | Pracht et al. . | |
| 4,035,307 | 7/1977 | Fry et al. . | |
| 4,041,205 | 8/1977 | Compa et al. . | |
| 4,073,735 | 2/1978 | Ramachandran . | |
| 4,073,996 | 2/1978 | Bedenk et al. . | |
| 4,077,890 | 3/1978 | Barker . | |
| 4,110,498 | 8/1978 | Benjamin et al. . | |
| 4,118,327 | 10/1978 | Seugnet . | |
| 4,124,116 | 11/1978 | McCabe . | |
| 4,156,592 | 5/1979 | Wood . | |
| 4,188,304 | 2/1980 | Clarke et al. | 206/0.5 |
| 4,223,029 | 9/1980 | Mahler et al. . | |
| 4,234,442 | 11/1980 | Cornelissens . | |
| 4,234,627 | 11/1980 | Schilling . | |
| 4,242,377 | 12/1980 | Roberts et al. . | |
| 4,259,373 | 3/1981 | Demessemaekers et al. . | |
| 4,292,035 | 9/1981 | Battrell . | |
| 4,308,024 | 12/1981 | Wells . | |
| 4,328,110 | 5/1982 | Green . | |
| 4,360,437 | 11/1982 | Wolfes . | |
| 4,395,342 | 7/1983 | Strauss . | |
| 4,410,441 | 10/1983 | Davies et al. . | |
| 4,422,949 | 12/1983 | Ooms . | |
| 4,439,335 | 3/1984 | Burns . | |
| 4,540,499 | 9/1985 | Sakatani et al. . | |
| 4,555,349 | 11/1985 | Butterworth et al. . | |
| 4,557,852 | 12/1985 | Schulz et al. . | |
| 4,588,080 | 5/1986 | Ginn | 206/0.5 |

FOREIGN PATENT DOCUMENTS

| | | |
|---|---|---|
| 2000177 | 2/1981 | United Kingdom . |

*Primary Examiner*—David T. Fidei

[57] ABSTRACT

The present invention is directed to a fabric-conditioning article for use in a washing machine having a wash, spin, and rinse cycle comprising a fabric conditioner and a water-absorbable material in a package which will permit passage of water and having at least one area which will open upon application of internal pressure for releasably containing the fabric conditioner. In use, the package is tossed into a washing machine at the beginning of the wash cycle. The package takes in or absorbs water, creating an internal pressure within the package. Upon exposure to the centrifugal force of the spin cycle, the package opens thereby releasing the conditioner into the water of the rinse cycle which activates the conditioner. Any conventional fabric conditioner, such as a fabric softener, can be utilized in conjunction with the package.

18 Claims, 1 Drawing Sheet

WASH-ADDED, RINSE-ACTIVATED FABRIC CONDITIONER AND PACKAGE

FIELD OF INVENTION

The present invention is directed to a fabric-conditioning article for use in a conventional automatic washing machine comprising a fabric conditioner, such as a softener. More particularly, the fabric-conditioning article is added to a washing machine having a wash, spin and rinse cycle at the beginning of the wash cycle, but the opening of the article to release the fabric conditioner is delayed until the beginning of the rinse cycle. The article is easily separated from the washed fabrics, for example, after removal from the washing machine or after the fabrics are dried in a dryer.

BACKGROUND OF INVENTION

Home laundering allows for the treatment of fabrics with a variety of materials which impart some desirable benefit or quality to the fabrics during the laundering. At each stage of the laundering operation, i.e., pre-soaking, washing, rinsing and drying, the fabrics are to a varying degree found in contact with water which can provide a medium for the delivery of a fabric-conditioning agent or agents. Delivery of the fabric-conditioning agent(s) to the fabrics, however, is not without certain difficulties.

Fabric conditioning in a home laundry is usually achieved by adding a liquid solution containing a fabric conditioner and, optionally, a dispersing agent to an automatic washing machine during the rinse cycle of the machine. Addition of the conditioner during the rinse cycle, rather than at the initiation of the wash cycle, is often required due to the chemical incompatibility of certain conditioning agents with the detergents used to launder the fabrics. Since the conditioner has to be added during the rinse cycle in order to be effective, the washing machine has to be monitored to determine when the rinse cycle begins. This makes the process of adding the conditioner inconvenient and time-consuming.

Various methods and devices have been utilized to improve the efficiency of applying a fabric conditioner to fabrics during the home laundering operation. Examples of relevant devices and methods of use are as follows:

U.S. Pat. Nos. 4,026,131 and 4,260,054 are directed to laundry additive dispensers or pouches for automatically introducing a laundry additive into the rinse water in automatic clothes washers. According to these patents, the dispenser or pouch is suitably attached to the central post of an agitator of an automatic clothes washer at the beginning of the wash cycle. The pouch contains a rupturable fold or weakened area, such as a slit, in the wall of the pouch whereby during the spin cycle immediately before the rinse cycle the rupturable fold or weakened area in the wall of the pouch will rupture and open, allowing the release of the contents of the pouch into the washer during the rinse cycle.

U.S. Pat. No. 4,356,099 (corresponding to European No. 0 040 931) discloses a fabric treatment product for use in a washing machine consisting of a bag formed of water-insoluble, water-impermeable synthetic plastic sheet material containing a fabric treatment composition, such as a detergent combination, in liquid form. The bag has a weak seal accomplished, for example, by inserting a non-woven fabric between the opposed bag walls of thermoplastic materials, and then heat-sealing to provide a weak seal. According to the patent, the weakened seal will cause the package to open during the first few minutes of the wash cycle of the washing machine operation. The release is not delayed for use in the rinse cycle.

U.S. Pat. No. 4,108,600 discloses a fabric conditioning article comprising a receptacle releasably containing a pH control agent or electrolyte and fabric-conditioning particles having a coating which is made indispersible by the pH control agent or electrolyte. The fabric-conditioning article is placed in a clothes washer at the beginning of the wash cycle. The receptacle has at least a part of one wall made of a water-insoluble porous material to allow for the release of the pH control agent or electrolyte during the wash cycle. The pH control agent or electrolyte causes the particle coating on the fabric conditioner to gel or precipitate and become water-insoluble. Once the electrolyte or pH control level drops below the gelling level, the particle coating begins to dissolve and disperse thereby releasing the fabric conditioner into the surrounding area. Preferably the fabric conditioner is not released until the washer rinse cycle or the drying cycle of a clothes dryer. The fabric-conditioning article disclosed in the U.S. Pat. No. 4,108,600 requires the use of an outer receptacle and a coating on the fabric-conditioning particles. Additionally, the use of an electrolyte or pH control agent to control the dispersibility of the fabric-conditioning agent is required.

U.S. Pat. No. 4,082,678 discloses a fabric conditioning article having a two-receptacle pouch and containing an electrolyte, pH control agent, and fabric softener. The U.S. Pat. No. 4,082,678 is similar in mechanism to the U.S. Pat. No. 4,108,600 discussed above. The difference is in the utilization of an inner receptacle for the fabric conditioner as opposed to a coating on the conditioner particles. At least a part of one wall of the outer receptacle is water-soluble or dispersible. The inner receptacle wall is made insoluble by the electrolyte and pH agent. Cellulose derivatives are disclosed as suitable materials for making the outer and inner receptacles. As with the U.S. Pat. No. 4,108,600 discussed above, the use of an electrolyte or pH agent to control the dispersibility of the fabric conditioner is required.

U.S. Pat. No. 4,304,562 discloses a fabric softener article added to a washer at the beginning of the wash cycle and having a delayed release, i.e., at the end of the wash cycle or the beginning of the rinse cycle. The softener containing article is a block of porous felt, cloth or foam, with fabric conditioner impregnated into an area of the block and with release being delayed until some time after the beginning of the wash cycle of the washing machine.

U.S. Pat. No. 4,203,851 discloses a free-flowing particulate fabric softening composition comprising a base bead impregnated with a fabric softener which is usable in a washer. The base bead can contain a waxy material to prevent premature reaction of the softener with anionic materials, or slow the rate of release of the softener so that less softener reacts with the anionic detergent. The base bead is composed of a builder such as zeolite or silicate.

U.S. Pat. Nos. 4,115,292; 3,186,869, and 3,322,674 disclose packages of water-soluble material, such as cellulose or cellulose derivatives, containing a material to be dispersed, such as a detergent or bleach. The '292 patent also discloses that starch or polyacrylics can be utilized as the water-soluble material of the package. Each of the packages disclosed in the above patents, however, is disclosed as being readily water-dissolvable and do not provide for the delayed release of the material contained within the package.

The prior art does not disclose a fabric conditioner containing package which can be added to the washing machine along with the fabrics, such as clothes, being washed and the detergent to effect cleaning at the beginning of the wash cycle of a conventional automatic washer and which does not release the fabric conditioner until the wash cycle is completed or the rinse cycle has begun.

OBJECTS OF THE INVENTION

A primary object of the present invention is to provide a fabric-conditioning article useful in the treatment of fabrics in a conventional washing machine which is added to the washing machine at the beginning of the wash cycle along with the fabrics and detergent, but where the release of the fabric conditioner is delayed until the wash cycle is completed or the beginning of the rinse cycle of the washing machine.

Another object of the present invention is to provide a fabric-conditioning article which is more efficient and convenient to use than the prior art fabric-conditioning articles due to the advantages that (1) the fabric-conditioning article can be added at the beginning of the wash cycle; (2) the fabric conditioner is pre-measured, thereby avoiding the problem of adding an insufficient or excessive amount of the conditioner; and (3) no mess is involved due to the pre-packaging of the fabric conditioner which does not involve any opening or dispensing of material.

Another primary object of the present invention is to provide an improved method of treating fabrics in a washing machine comprising adding a fabric conditioner containing article to the wash cycle of a washing machine which does not release the fabric conditioner until the wash cycle is completed or the beginning of the rinse cycle of the washing machine, with the article leaving no harmful residue or material.

These and other objects of the invention will be apparent from the following description of the invention.

BRIEF DESCRIPTION OF THE INVENTION

The wash-added, rinse-activated fabric conditioner article of the present invention comprises a package having at least one wall or area which will open due to application of internal pressure, containing a fabric conditioner and a water-absorbable or water-swellable material which is tossed into a washing machine at the beginning of the wash cycle along with a detergent and the fabrics to be treated. The package takes in water, swells, and breaks open at the spin cycle or the beginning of the rinse cycle due to the centrifugal force of the washing machine during a spin cycle, thereby releasing the fabric conditioner into the water of the rinse cycle which activates the conditioner formulation. The package is removed from the washer at the end of the rinse cycle along with the fabric being treated.

The fabric-conditioning agent contained in the package for delayed release is preferably a fabric softener, but can also be any other suitable fabric-conditioning agent such as a perfume, antistatic agent, antimicrobial agent, whitening or bluing agent, enzymes, stain-removing agent, bleaching agent, soil-releasing agent, water- and stain-repellent agent, or the like.

GENERAL DESCRIPTION OF THE INVENTION

The fabric-conditioning article of the present invention is for use in home laundering or laundromat laundering of fabrics in a conventional automatic washing machine, i.e., a washer having a wash, a spin, and a rinse cycle. The conventional automatic washing machines for home laundering are one of two types. In one type of washing machine, such as the Whirlpool or Sears washers, both the shaft and washing machine drum spins during the spin cycle. In the other type of washer, such as the Maytag and General Electric, the drum only spins. In both types of washers approximately ninety percent of the wash water is removed from the washing machine by draining out through the bottom of the washing machine. The final water content, approximately ten percent, is removed by spinning. In the spinning cycle the greatest centrifugal force is at the end of the spinning, i.e., when most all of the water is removed. The fabric-conditioning article of the present invention relies on the above characteristics and comprises a fabric-conditioning agent contained in a package having at least one weak seal or area which will open upon application of the centrifugal force of the spin cycle.

The fabric-conditioning article of this invention is added to the washing machine at the beginning of the wash cycle. There is no need, therefore, to monitor the washing operation. The structure of the package is such that it retains the fabric-conditioning agent inside the package free from substantial reaction with the fabrics or detergent during the wash cycle. During the wash cycle, the package takes in or absorbs water and swells, creating internal pressures within the package. The centrifugal forces created in the spin cycle cause the swollen package to break open and release the fabric-conditioning agent into the water of the rinse cycle. The water of the rinse cycle and the agitation disperses the fabric-conditioning agent so that it can contact the fabrics contained in the washing machine. The empty package is either removed from the washing machine after the rinse and spin cycles along with the fabrics which were washed, and then separated; or after drying while sorting and folding the fabrics for storage.

The fabric-conditioning article is completely self-contained and requires no action on the part of the user other than placement of the article in the washing machine at the beginning of the wash cycle in order for the fabric-conditioning article to serve its intended purpose of treating the fabrics contained in the washing machine. The amount of the fabric-conditioning agent contained in the fabric-conditioning article is predetermined in view of the particular purpose of the fabric-conditioning agent so that the user does not have to measure out any material. Particularly suitable fabric-conditioning agents are discussed further hereinafter.

The package, preferably of a pouch-like or bag form, is made up of materials, including non-woven or plastic materials, which are permeable to water. Suitable packaging materials are pouches, bags, or the like fabricated from a sheet material. The basic requirement for the sheet material is that the package is water-permeable over at least a part of the exposed surface but is water-insoluble. In one preferred construction, two heat-sealable sheets both being composed of long-fiber cellulosic papers having a nonwoven web of Vinyon, a thermoplastic fiber composed of a copolymer of vinylchloride and vinylacetate marketed under the tradename "Berkshire Heat-Seal" paper by Kimberly-Clark at one surface, are heat-sealed together at all four edges to form a substantially square or rectangular package. In another preferred construction, one sheet only of the heat-seal paper as above described and one sheet of non-heat-sealable long-fiber cellulosic paper such as that marketed under the tradename "Taconic" by Kimberly-Clark are laminated together at their edges to form a substantially square or rectangular package. One of the seals is a weak seal capable of being ruptured by internal pressures.

In still another preferred construction, one heat-sealable sheet and one non-heat-sealable sheet are laminated together at their edges to form a substantially square or rectangular package. The non-heat-sealable sheet, because of its weakened condition after being exposed to water and the agitation of the wash cycle, will rupture as a result of the centrifugal force of the spin cycle. In still another preferred construction, one water-impermeable sheet and one water-permeable sheet are laminated together at their edges to form a substantially square or rectangular package. During the wash cycle the package will absorb water through the water-permeable surface, and will rupture as a result of the centrifugal force of the spin cycle. It can be desirable to provide a weakened area over the surface in any of the above structures by punching needle holes or the like over a surface of the package. The needle-punched holes will initially absorb water to form a thin film barrier, as will be considered more fully hereinafter, which barrier will prevent the leakage of the fabric conditioner from the package. However, the needle holes will provide for a rupture of the package upon the centrifugal force of the spin cycle.

Other preferred non-woven materials for use herein are the non-woven synthetic plastic sheet materials such as polyethylene, polypropylene, polystyrene, polyester especially polyethyleneterephthalate; vinyl polymers such as insoluble polyvinylacetate and polyvinylacrylate, polyvinylchloride, polyvinylalcohol, a combination of any of these and other synthetic materials, or a combination of natural and synthetic materials which are insoluble to water but, either inherently or due to a porous or fibrous structure, permit the passage of water. The package or pouch will have an opening for filling the package or pouch with the fabric-conditioning agent, water-absorbable material, and other components of the fabric conditioning formulation. After the conditioning formula is added to the pouch or package, the opening is sealed. Sealing can be accomplished by using a weak heat-seal either at one end of the bag or, preferably, in the center of the bag or pouch where the greatest expansion will occur. Alternatively, the bag can be sealed by a teabag-type closure where the ends are lapped in and over, with a zip-seal sandwich-bag type seal, with gluing of the opening, with sewing for example with a straight or zig-zag line, or the like. The pouch or bag can be in any shape, such as a rectangle, triangle, circular, tubular, or trapezoidal shape. It is only essential that the package or pouch will absorb water during the wash cycle, thereby swelling the package but at the same time being such that the package will not open until the centrifugal force of the washing machine spin cycle puts pressure on the swollen package and causes it to open.

The water-swellable material can be any material which will take up large quantities of water such as the superabsorbent materials which are water-insoluble hydrocolloidals or hydrocolloidal polyelectrolytes of the type described, for example, in U.S. Pat. Nos. 3,670,731 and 4,043,952; as well as starch, modified starches, i.e., starch/acrylate copolymers and graft copolymers; starch derivatives which are starches mixed with carboxymethylcellulose or crosslinked with carboxymethylcellulose and cellulosic gums. These materials, preferably powders, when in contact with water will absorb several times their weight of water and remain as a gel without instantaneous dissolution and while providing a ballooning effect. This ballooning effect will create an internal pressure within a package containing the materials; and, accordingly, the package will have a tendency to rupture or break open particularly in any weakened area. Since the fabric-conditioner formulation is a dispersible gel, it will readily release from the package. Further, the material used is preferably a colloidal-forming dispersing agent in that such dispersions have less of a tendency to pass through the pores of the package. Additionally, the colloidal-forming agents have a greater tendency to absorb water by capillary absorption as opposed to surface absorption. Capillary absorption allows for the absorption of greater quantities of water. Although powders are presently preferred, the fabric-conditioner formulation can also be in the form of tablets, granules, or gels.

Although not essential, it can be desirable to include in the package along with the water-absorbable material additional agents such as a surfactant, or a salt such as sodium chloride, sodium sulfate, and the like. These salts can improve the water-absorption of the water-absorbable material, such as starch, and also the pouch or bag material. Additionally, some salts upon being solubilized in water will undergo an exothermic reaction which again can improve the water-absorptive capabilities and dispersibility of the material. Such salts will have a tendency, due to the exothermic reaction, to pull the water into the package and thus help water passage. Certain cationic, anionic, and nonionic surfactants can also improve the water wettability and dispersibility of the fabric conditioner and water-absorptive material. It is also possible to include a reactive pair such as the carbonates or bicarbonates and an acid, such as sodium bicarbonate and citric or tartaric acid, which will react in the presence of water to form a gas such as carbon dioxide. As the gas is released, it initially expands the package, aiding floatation of the package, and then the water passes into or is pulled into the mixture to expand the mixture, thus increasing the internal pressure within the package. This internal pressure will, accordingly, assist in the opening of the package upon application of the centrifugal force.

The composition which is utilized in the package of the present invention must be capable of collecting or absorbing water, thus swelling to create internal pressure, while being retained in the package. A solid material in particulate form is preferred. The particles must not be so small, however, as to allow the particles to pass through the sheet material making up the pouch or bag. If a gel is used, it too must be retained in the package.

It has been found that during the operation of the washing machine, water, during the wash cycle, will be absorbed by or penetrate into the package containing the fabric-conditioner composition. During the initial absorption of water into the package during washing, a reaction between the anionic detergent and the cationic fabric conditioner may occur forming an anion-cation complex at the inner and outer surface of the package. Once formed, this salt forms a barrier and protects the remaining ingredients inside the package from further reaction with the detergent. As a result of the barrier, mostly pure water will pass through the package for absorption by the swelling material. Because of the reaction between the anionic detergent and fabric conditioner, it is preferable that the water-absorbable material have cationic characteristics such as cationic starches. These materials will react with the anionic detergents to form the barrier and preserve the cationic fabric conditioners. At the completion of the wash cycle, the water-absorbent material will be substantially completely impregnated with water. The water of the wash cycle is removed from the washer, first by allowing the water to drain from the washing machine and then with the final water being drained by spinning in a spin cycle. The centrifugal force which is the greatest at the end of the spin cycle, i.e., when most all of the water has been removed, will cause the package to open and permit the release of the fabric conditioner for utilization in the rinse cycle.

Any conventional fabric-conditioning agent which is suitable for use in the treatment of fabrics following the washing of fabrics can be used according to the present invention. Examples of suitable fabric-conditioning agents include softening agents, perfumes, antistatic agents, antimicrobial agents, soil-releasing agents, bleaching agents, or the like. Preferably, the fabric-conditioning agent is a fabric-softening agent, which generally can be grouped into the following classes which contain compounds having at least one long chain group: (1) cationic quaternary ammonium salts; (2) nonionic compounds such as tertiary amine oxides; (3) anionic soaps, sulfates, and sulfonates; (4) zwitterionic compounds; (5) ampholytic compounds; (6) tertiary amines and salts; and (7) compatible mixtures of one or more compounds of these classes. An example of a particularly suitable fabric-softening composition for use in the present invention is described in a concurrently filed application entitled "Fabric Conditioner Comprising A Mixture Of Quaternary Ammonium Compounds And Select Tertiary Amine Oxides" wherein the softener includes one or more quaternary ammonium or quaternary imidazolinium compounds and a tertiary amine oxide as the active softening/antistatic agent. Additionally, a filler, a pH control agent and/or a pH buffer, a dispersant, a reinforcing material, such as sodium carbonate, and a surfactant or rinsing aid, such as citric acid, can be included. Each of the above components is preferably present in an amount as follows:

| Ingredients | Preferred Composition Parts by Weight | Range Parts by Weight Low–High |
|---|---|---|
| Quaternary ammonium compound or quaternary imidazolinium compound | 53.50 | 50–97.5 |
| Didecyl methylamine oxide | 11.46 | 2.5–50 |
| Surfynol 104-H (surfactant) | 0.19 | 0–20 |
| Perfume, liquid or encapsulated | 2.38 | 0–20 |
| Citric Acid | 0.90 | 0–4.5 |
| Sodium Carbonate | 1.48 | 0–7.4 |

In the fabric-conditioner formulation of the present invention the water-absorbable or water-swellable material will normally comprise from about 1 to 70 percent by weight and the fabric-conditioner composition will normally comprise from about 99 to 30 percent by weight of the total fabric conditioner formulation.

PRESENTLY PREFERRED EMBODIMENTS

Having described the invention in general terms, the present preferred embodiments will be described in reference to the drawing and the detailed examples. In the drawing, FIG. 1 is a perspective view of a package having a water-swellable fabric softener composition contained therein;

Figure 5:
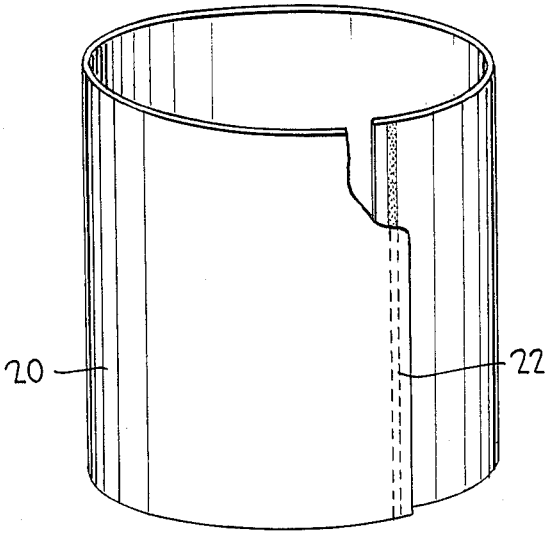
Figure 7:
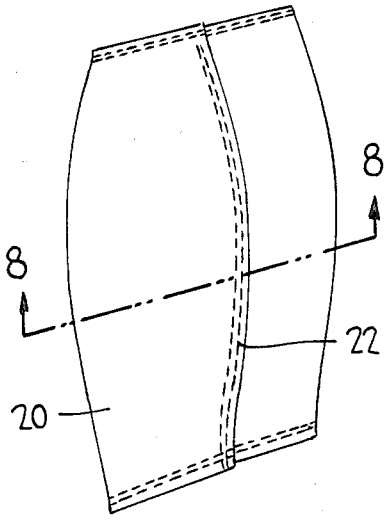
Figure 6:
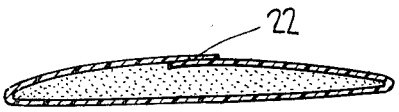
Figure 8:
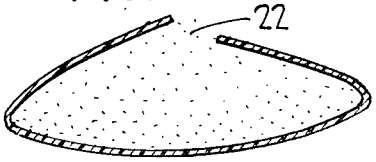

FIG. 5 relates to a second embodiment of the invention and discloses a tube formed from a sheet material;

FIG. 6 is a sectional view of a package containing a water-swellable fabric softener composition formed by sealing one end of the tube of FIG. 5 to form a bag, followed by filling the bag with a water-swellable fabric softener composition;

FIG. 7 illustrates the package of FIG. 6 after the water-swellable fabric softener composition has absorbed water, expanding the water-swellable fabric softener composition to rupture the seal; and FIG. 8 is a sectional view taken along line 8—8 of FIG. 7 illustrating the ruptured seal.

EXAMPLE 1

Two sheets 14 and 16 of long-fiber cellulosic papers having a web of Vinyon sold under the tradename "Berkshire Heat-Seal" paper by Kimberly-Clark were heat-sealed on two sides and one end. The package is approximately 3"×2". The package is filled with approximately 5 grams of a composition as follows:

| Component | Amount |
|---|---|
| Ditallow-dimethyl ammonium chloride | 38.21 g |
| Dibehenyl dimethyl ammonium chloride | 15.29 g |
| Didecyl methylamine oxide | 11.46 g |
| Starch/Modified Starch | 30.09 g |
| Surfynol 104-H (surfactant) | 0.19 g |
| Perfume | 2.38 g |
| Citric Acid | 0.90 g |
| Sodium Carbonate | 1.48 g |
| Total | 100.00 g |

Surfynol 104-H is a ditertiary acetylenic diol which acts as a surfactant.

Figure 1:
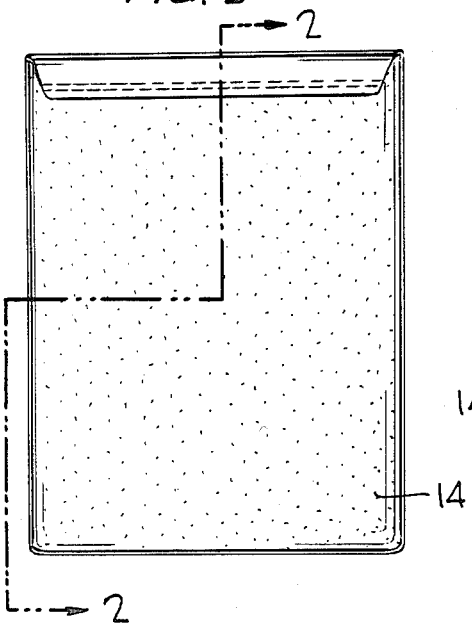
Figure 2:
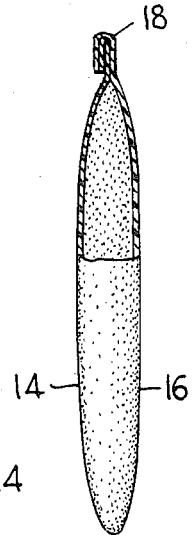
FIG. 2 is a sectional view of the package of FIG. 1 taken along lines 2—2 thereof.
Figure 3:
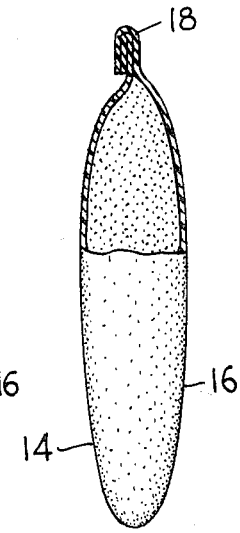
FIG. 3 is a view the same as FIG. 2 except after the water-swellable fabric softener composition has absorbed water.
Figure 4:
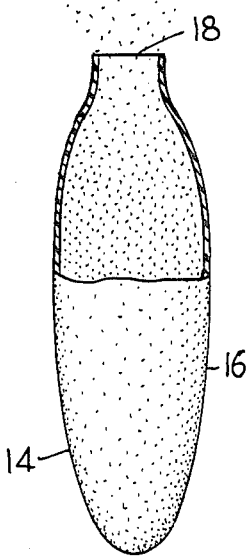
FIG. 4 is a view the same as FIGS. 2 and 3 except that the water-swellable fabric softener composition has absorbed water to the extent that the internal pressures have forced open the fill-end of the package.

After filling the package, the unsealed fill-end 18 was sealed as shown in FIGS. 1–3. The package was added to a top-loading Whirlpool washer along with turkish towels and a conventional laundry detergent. The washer was filled with water and passed through the regular operation of the washer. In observing the package during the wash cycle, it was seen that the package was agitated within the wash water along with the towels. The package floats on the water surface, and periodically submerges and reappears on the surface of the water. The package remained intact throughout the wash cycle but noticeably grew in size as illustrated in FIG. 3. After the wash water was drained, and the last traces of water removed in the spin cycle, the rinse water filled into the machine drum. Upon agitation it was seen that the package had opened at least at its fill-end 18. Over a period of approximately two minutes the contents of the package was dispersed into the rinse water. An examination of the package after the rinse cycle and spin dry cycle were completed showed that the package was completely empty and free of any fabric conditioner.

EXAMPLE 2

A non-woven polypropylene sheet 20 was rolled into a tube as shown in FIG. 5 and pressed so that the two ends of the tube met and overlapped approximately at the center of one of the faces of the package. The center opening 22 where the ends of the tube meet was sealed with an adhesive material to provide a weak seal. One end of the tube was initially heat-sealed. The package was filled with a composition as utilized in Example 1 except in this example the starch was replaced with a superabsorbent material sold under the tradename "Aquasorb" and marketed by Aqualon. After filling the package, the filling end of the package was heat-sealed. The package was utilized in a Whirlpool washer in the same manner as was the package in Example 1. The package opened along the center opening 22 during the rinse cycle and dispersed the contents of the package into the rinse water.

In the above examples, the fabric softener blend can be replaced with other fabric softeners and fabric conditioners as long as the material is retained in the package. Additionally, the water-absorbent material can be replaced with other water-swellable or absorptive materials as long as they will absorb large amounts of water so as to create internal pressures within the package. The packaging material can be replaced by other materials, it only being necessary that the packaging material be water-permeable, but water-insoluble. The package can be of any shape including a rectangle, a triangle, round, including as in the shape of a doughnut, and the like. The ratios of components of the fabric-conditioner formulation can vary widely, it only being necessary that the desired fabric-conditioning properties be imparted and that the formulation is sufficiently swellable to provide internal pressures which will open the package along at least one weakened area by delamination of a heat-seal, breaking of an adhesive bond, rupture of the packaging material, or the like. Further, the peel-strength or tear-strength of the weakened area of the package can vary substantially. However, it has been found that usually the peel-strength or tear-strength will be within the range of 9 grams per cubic centimeter to about 90 grams per cubic centimeter.

As will be apparent to one skilled in the art, various modifications can be made within the scope of the aforesaid description. For example, a string can be attached to the bag or package for hanging of the package onto an agitator. In this way the whereabouts of the package is always known. As another example, it is possible to form the package of the present invention as a multiple pouch. In the case of a double pouch, one of the pouches will be constructed in accordance with the present invention so as to rupture at the end of the wash cycle or at the beginning of the rinse cycle. The second pouch, however, can be designed to release a detergent or other fabric-conditioners during the wash cycle of the washing operation. For example, the pouch can be designed to absorb water and release a detergent and/or a bleach at the beginning of the wash cycle or during the first few minutes of the wash cycle. Additionally, it can be desirable to release two or more materials in the rinse cycle which are incompatible during storage and, accordingly, not desirable to have in a single pouch. In such instances, the package can be a double pouch both containing the water-absorbable material which will rupture the pouch at the end of the wash cycle, dispersing the storage incompatible fabric-treating compositions into the rinse water for contact with the fabric. Such modifications being within the ability of one skilled in the art form a part of the present invention and are embraced by the appended claims.

It is claimed:

1. A fabric-conditioning article for use in a washing machine having a wash cycle, a spin cycle and a rinse cycle, said spin cycle producing centrifugal forces, comprising (a) a water-permeable, water-insoluble package having at least one area which will open upon application of internal pressure to said at least one area; and (b) a fabric-conditioner formulation within said package, said formulation including a water-absorbent material which will swell in the presence of water to create an internal pressure, and an effective amount of a fabric-conditioning composition within said package, said water-absorbent material being present in an amount sufficient whereby said material upon exposure to water will swell to create internal pressure within said package and when said package is subsequently exposed to centrifugal force said package will open at said at least one area.

2. The fabric-conditioning article of claim 1 wherein said fabric-conditioner formulation is in the form of a powder.

3. The fabric-conditioning article of claim 1 wherein said fabric-conditioner formulation is in the form of a tablet.

4. The fabric-conditioning article of claim 1 wherein said fabric-conditioner formulation is in the form of granules.

5. The fabric-conditioning article of claim 1 wherein said fabric-conditioner formulation is in the form of a water-dispersible, water-insoluble gel.

6. The fabric-conditioning article of claim 1 wherein said water-absorbing material is selected from the group consisting of starch, a modified starch, a particulate superabsorbent hydrocolloidal material and cellulosic gum.

7. The fabric-conditioning article of claim 6 wherein said superabsorbent hydrocolloidal material is a hydrocolloidal polyelectrolyte.

8. The fabric-conditioning article of claim 1 wherein said fabric-conditioning composition is selected from the group consisting of a fabric softener, perfume, antistatic agent, antimicrobial agent, soil-releasing agent, or bleaching agent.

9. The fabric-conditioning article of claim 8 wherein said fabric-conditioning composition is a fabric softener containing a fabric-softening agent selected from the group consisting of cationic agents, nonionic agents, ampholytic agents, zwitterionic agents, or mixtures thereof.

10. The fabric-conditioning article of claim 9 wherein said fabric-conditioning composition is a fabric softener containing a mixture comprising ditallow-dimethyl ammonium chloride, dibehenyl dimethyl ammonium chloride, and didecyl methylamine oxide.

11. The fabric-conditioning article of claim 9 wherein the water-absorbing material is a modified starch.

12. The fabric-conditioning article of claim 9 wherein the water-absorbing material is a cellulosic gum.

13. A method of treating fabrics in a washing machine having a wash cycle, a spin cycle and a rinse cycle, said spin cycle including spinning to generate a centrifugal force, comprising adding to said washing machine at the beginning of said wash cycle a fabric-conditioning article comprising (a) a water-permeable, water-insoluble package having at least one area which will open upon application of internal pressure to said at least one area;

(b) a fabric-conditioner formulation within said package, said formulation including a water-absorbent material which will swell in the presence of water to create an internal pressure, and an effective amount of a fabric-conditioning composition within said package, said water-absorbent material being present in an amount sufficient whereby said material upon exposure to water will swell to create internal pressure within said package and when said package is subsequently exposed to centrifugal force said package will open at said at least one area, wherein said package will retain said fabric-conditioning composition inside said package upon exposure to water but which upon subsequent exposure to the centrifugal force will open and release said fabric-conditioning composition into said washing machine.

14. The method of claim 13 wherein said water-absorbing material is selected from the group consisting of starch, a modified starch, a cellulosic gum, and a particulate superabsorbent polyelectrolyte.

15. The method of claim 14 wherein said fabric-conditioning composition is selected from the group consisting of a fabric softener, perfume, antistatic agent, antimicrobial agent, soil-releasing agent, or bleaching agent.

16. The method of claim 15 wherein said fabric-conditioning composition is a fabric softener containing a fabric-softening agent selected from the group consisting of cationic agents, nonionic agents, ampholytic agents, zwitterionic agents, or mixtures thereof.

17. The method of claim 16 wherein said fabric-conditioning composition is a fabric softener containing a mixture of ditallow-dimethyl ammonium chloride, dibehenyl dimethyl ammonium chloride, and didecyl methylamine oxide.

18. The method of claim 17 wherein the water-absorbing material is modified starch.

* * * * *